US008371717B2

(12) United States Patent
Lai

(10) Patent No.: US 8,371,717 B2
(45) Date of Patent: Feb. 12, 2013

(54) LED LIGHT EMITTING DEVICE HAVING TEMPERATURE SENSOR FOR CONTROLLING CURRENT SUPPLIED TO LEDS THEROF

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 278 days.

(21) Appl. No.: 12/859,191

(22) Filed: Aug. 18, 2010

(65) Prior Publication Data

US 2012/0019144 A1 Jan. 26, 2012

(30) Foreign Application Priority Data

Jul. 20, 2010 (TW) ..... 99123876 A

(51) Int. Cl.
*H01J 61/52* (2006.01)

(52) U.S. Cl. ..... 362/276; 362/545; 362/235; 362/294; 362/297; 313/46

(58) Field of Classification Search ..... 362/276; 313/46

See application file for complete search history.

(56) References Cited

U.S. PATENT DOCUMENTS

| | | | | |
|---|---|---|---|---|
| 6,601,983 | B1 * | 8/2003 | Runfola et al. | 362/545 |
| 6,659,632 | B2 * | 12/2003 | Chen | 362/545 |
| 7,347,589 | B2 * | 3/2008 | Ge | 362/294 |
| 2007/0114225 | A1 | 5/2007 | Smith et al. | |
| 2007/0116443 | A1 * | 5/2007 | Ptak | 392/407 |
| 2007/0247855 | A1 * | 10/2007 | Yano | 362/294 |
| 2010/0149785 | A1 | 6/2010 | Dubuc et al. | |
| 2010/0207142 | A1 * | 8/2010 | Chen et al. | 257/98 |

FOREIGN PATENT DOCUMENTS

JP 2009-123364 6/2009

* cited by examiner

*Primary Examiner* — Tracie Y Green
(74) *Attorney, Agent, or Firm* — Altis Law Group, Inc.

(57) ABSTRACT

An LED light emitting device includes a lamp housing, an LED light emitting component thermally attached to the lamp housing, a power source driver for providing electric energy for the LED light emitting component, and a temperature sensor attached to the lamp housing for sensing a surface temperature of an outer surface of the lamp housing. When the value of the surface temperature is smaller than a predetermined temperature value, the temperature sensor outputs a control signal to the power source driver to control the power source driver to supply a larger electric current to the LED light emitting component, and the LED light emitting component generates more heat to the lamp housing to increase the surface temperature thereof.

8 Claims, 10 Drawing Sheets

LED LIGHT EMITTING DEVICE HAVING TEMPERATURE SENSOR FOR CONTROLLING CURRENT SUPPLIED TO LEDS THEROF

BACKGROUND

1. Technical Field

The present disclosure relates to an LED (light-emitting diode) light emitting device with good ice-proof performance.

2. Description of Related Art

An LED (Light-Emitting Diode) lamp as a new type of light source can generate brighter light, and have many advantages, e.g., energy saving, environment friendly and longer life-span, compared to conventional light sources. Therefore, the LED lamp has a trend of substituting for conventional light sources.

Many cities apply the LED lamps to street lamps and traffic lights for saving electric energy. However, the LED lamp generates less heat when working, thus the temperature of the light source of the LED lamp is lower than conventional light sources. After encountered a heavy snow weather, water vapor is often accumulated around the LEDs and then turns into ice, so that the road surface can not obtain enough illumination from the street lamps, and signals generated from the traffic light can not be seen clearly, which results in malfunctions of the street lamps and the traffic lamps or even traffic accidents.

What is needed, therefore, is an LED light emitting device which can overcome the limitations described.

DETAILED DESCRIPTION

Figure 1:
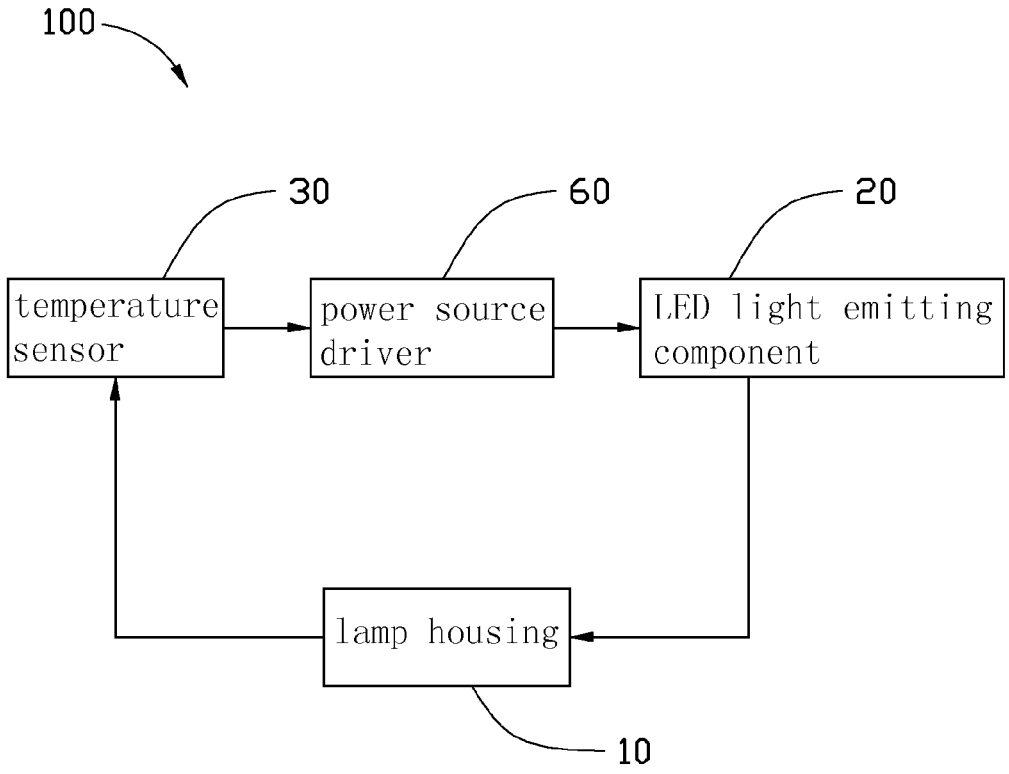
FIG. 1 is a block diagram of an LED light emitting device in accordance with a first embodiment of the disclosure.
Figure 2:
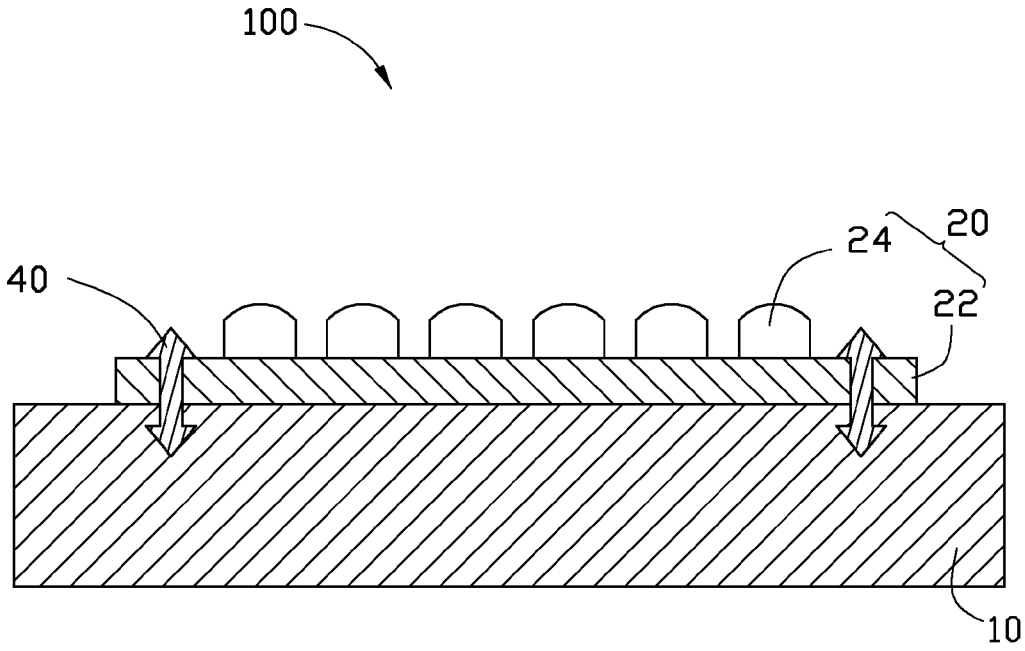
FIG. 2 is an isometric, assembled view of the LED light emitting device of FIG. 1.

Referring to FIGS. 1-2, an LED light emitting device 100 in accordance with a first embodiment is shown. The LED light emitting device 100 can be applied to a street lamp, a traffic light or a billboard. The LED light emitting device 100 includes a lamp housing 10, an LED light emitting component 20 thermally attached to the lamp housing 10, a temperature sensor 30 connected to the lamp housing 10, and a power source driver 60 for providing electric energy for the LED light emitting component 20.

Figure 3:
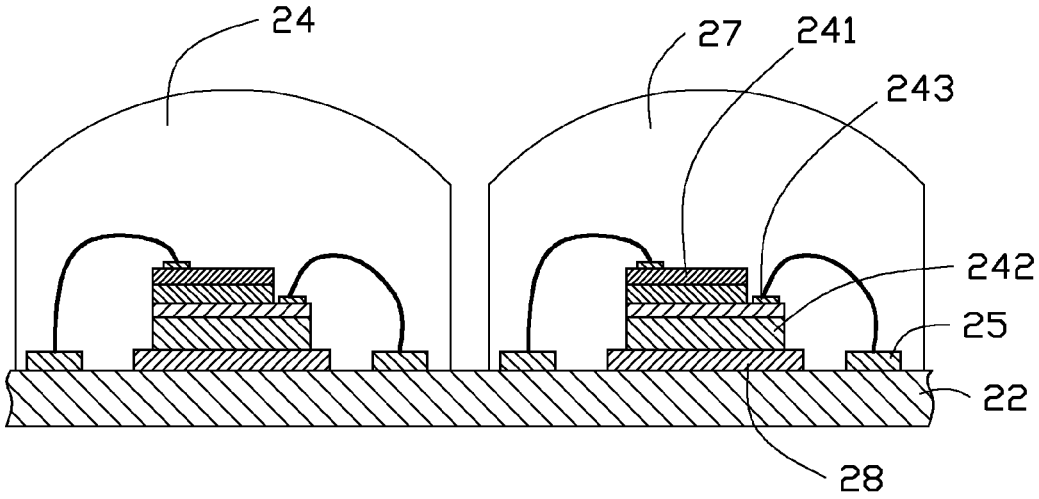
FIG. 3 is a partially enlarged cross-sectional view of an LED light emitting component of the LED light emitting device of FIG. 2.

Also referring to FIG. 3, the LED light emitting component 20 includes a flat heat conductive plate 22, a plurality of LEDs 24 thermally attached to the heat conductive plate 22, and an electrode circuit layer 25 formed on the heat conductive plate 22. Each LED 24 includes a substrate 242, an LED die 241 disposed on the substrate 242, two electrodes 243 formed on the LED die 241, and an encapsulant 27 encapsulating the LED die 241 for isolating water vapor from the LED die 241. The electrodes 243 electrically connect with the electrode circuit layer 25.

The LED die 241 can be a phosphide represented by general formula $Al_xIn_yGa_{(1-x-y)}P$, here $0 \leqq x \leqq 1$, $0 \leqq y \leqq 1$ and $x+y \leqq 1$; or an arsenide represented by general formula $Al_xIn_yGa_{(1-x-y)}As$, here $0 \leqq x \leqq 1$, $0 \leqq y \leqq 1$ and $x+y \leqq 1$. The LED die 241 can also be made of a semiconductor material being capable of emitting light of a wavelength which can excite fluorescent material, for example, the LED die 241 can be of an oxide such as ZnO, or a nitride, such as GaN. The LED die 241 is preferably made of a nitride semiconductor material represented by general formula $In_xAl_yGa_{(1-x-y)}N$, here $0 \leqq x \leqq 1$, $0 \leqq y \leqq 1$ and $x+y \leqq 1$, which can emit light of short wavelengths ranged from ultraviolet light to blue light to excite fluorescent material. The substrate 242 can be made of an intrinsic semiconductor or an unintentionally doped semiconductor. The substrate 242 can be of a semiconductor material, such as spinel, SiC, Si, ZnO, GaN, GaAs, GaP or AlN. The substrate 242 can also be of a material with good thermal conductivity but poor electrical conductivity, such as diamond. The carrier concentration of the substrate 242 is preferably $5\times10^6$ $cm^{-3}$ or lower, and more preferably $2\times10^6$ $cm^{-3}$ or lower, so that the electric current can be electrically insulated from flowing through the substrate 242.

The heat conductive plate 22 employs a ceramic material with properties of electrically insulating, high thermal conductivity and low thermal expansion, such as $Al_xO_y$, AlN or $ZrO_2$, so that the electrode circuit layer 25 can be directly formed on the heat conductive plate 22. The heat conductive plate 22 has a thermal conductivity larger than 20 W/mK. The heat conductive plate 22 is flat and has a coefficient of thermal expansion substantially equal to that of the substrate 242 of the LED 24.

The heat conductive plate 22 and the LEDs 24 are joined together by eutectic bonding, whereby an eutectic layer 28 is formed between the heat conductive plate 22 and the LEDs 24. The eutectic layer 28 contains at least one selected from Au, Sn, In, Al, Ag, Bi, Be or an alloy thereof. The electrode circuit layer 25 is spaced from the eutectic layer 28.

The electrode circuit layer 25 can be of at least one selected from Ni, Au, Sn, Be, Al, In, Ti, Ta, Ag, Cu or an alloy thereof. Alternatively, the electrode circuit layer 25 can be of a transparent conducting oxide (TCO), such as Indium Tin Oxides (ITO), Ga-doped ZnO (GZO) or Al-doped ZnO (AZO). The electrode circuit layer 25 can be formed on the heat conductive plate 22 by physical deposition method, such as sputter, Physical Vapor Deposition (PVD) or e-beam evaporation deposition. The electrode circuit layer 25 can also be formed on the heat conductive plate 22 by chemical deposition method, such as chemical vapor deposition (CVD), electroplating chemical deposition or screen printing.

The encapsulant 27 can be made of silicone, epoxy resin or PMMA. To convert wavelength of light generated from the LEDs 24, a fluorescent material such as sulfides, aluminates, oxides, silicates or nitrides, can be filled and scattered in the encapsulant 27.

Figure 4:
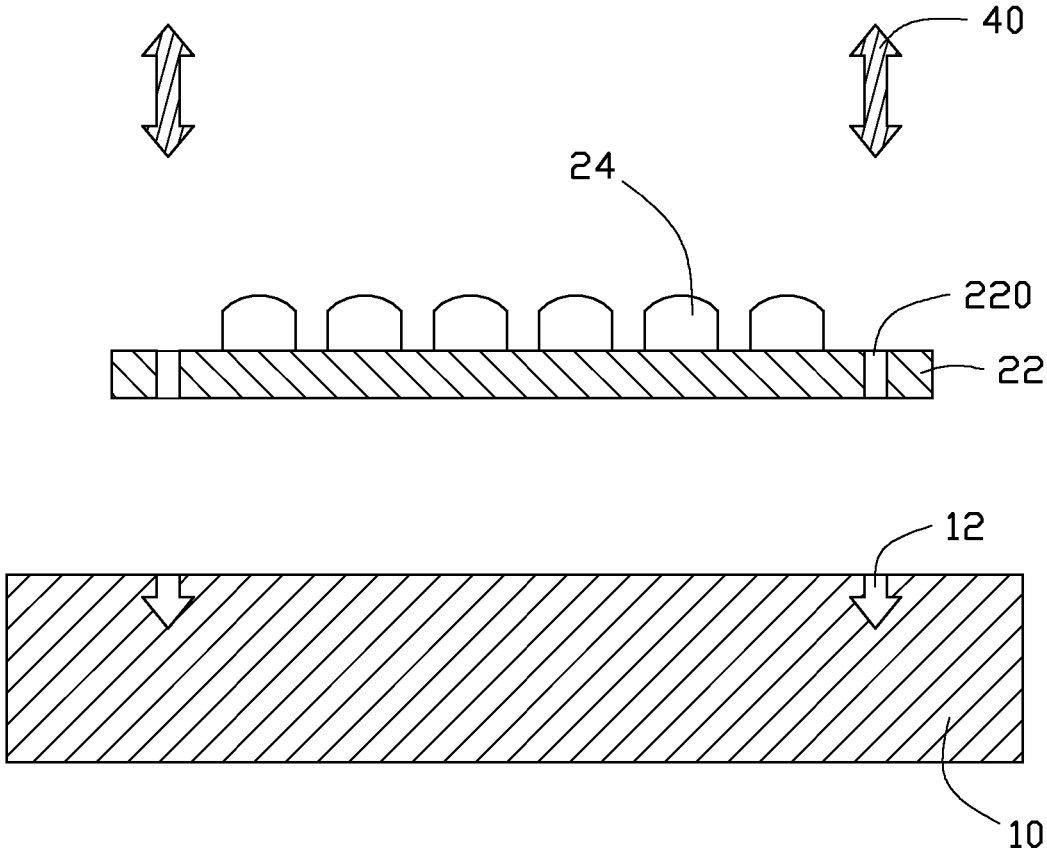
FIG. 4 is an exploded view of the LED light emitting device of FIG. 2.

Also referring to FIG. 4, the heat conductive plate 22 defines two through holes 220. The lamp housing 10 defines two fixing holes 12 corresponding to the two through holes 220 of the heat conductive plate 22. Two fasteners 40 extend through the through holes 220 of the heat conductive plate 22 and are buckled in the fixing holes 12 of the lamp housing 10, to thereby fasten the LED light emitting component 20 on the lamp housing 10 and make the heat conductive plate 22 intimately contact the lamp housing 10.

The temperature sensor 30 is attached to an outer surface of the lamp housing 10 for sensing a surface temperature of the outer surface of the lamp housing 10. When the value of the surface temperature is smaller than 0 Celsius degree, the temperature sensor 30 outputs a control signal to the power source driver 60 to control the power source driver 60 to supply a larger electric current to the LED light emitting component 20. Thus, the LED dies 241 of the LED light emitting component 20 generate more heat to the heat conductive plate 22 and the lamp housing 10 to increase the surface temperature of the lamp housing 10, thereby maintaining the surface temperature of the outer surface of the lamp housing 10 to be larger than 0 Celsius degree, and preventing the lamp housing 10 and the LEDs 24 of the LED light emitting component 20 from being covered by ice.

Figure 5:
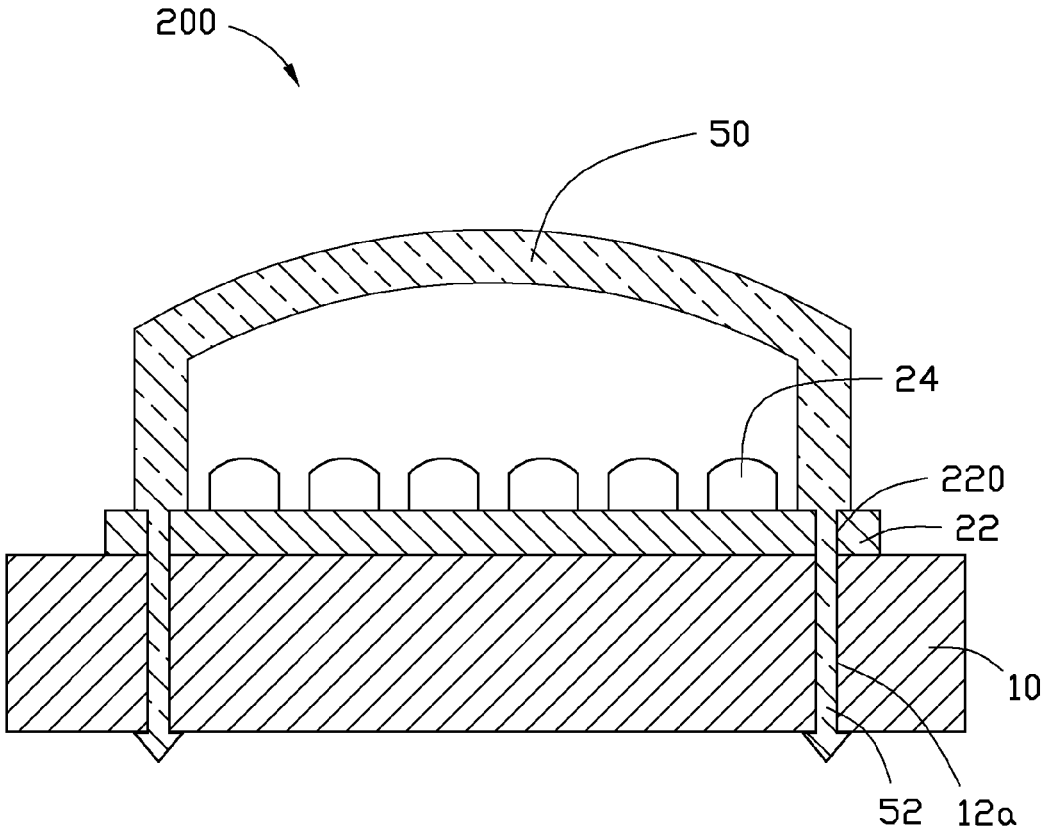
FIG. 5 is a schematic view of an LED light emitting device in accordance with a second embodiment of the disclosure.

Also referring to FIG. 5, an LED light emitting device 200 in accordance with a second embodiment is shown. The differences of the second embodiment relative to the first embodiment are that: the LED light emitting device 200 further includes a hollow envelope 50 covering the LEDs 24 on the heat conductive plate 22, for further isolating water vapor from the LEDs 24. Two fasteners 52 extend vertically downwardly from the envelope 50. The heat conductive plate 22 defines two through holes 220. The lamp housing 10 defines two through fixing holes 12*a*, corresponding to the through holes 220 of the heat conductive plate 22. The fasteners 52 of the envelope 50 extend through the through holes 220 of the heat conductive plate 22 and the fixing holes 12*a* of the lamp housing 10, to thereby connect the heat conductive plate 22 with the lamp housing 10 and make the heat conductive plate 22 intimately contact the lamp housing 10.

Figure 6:
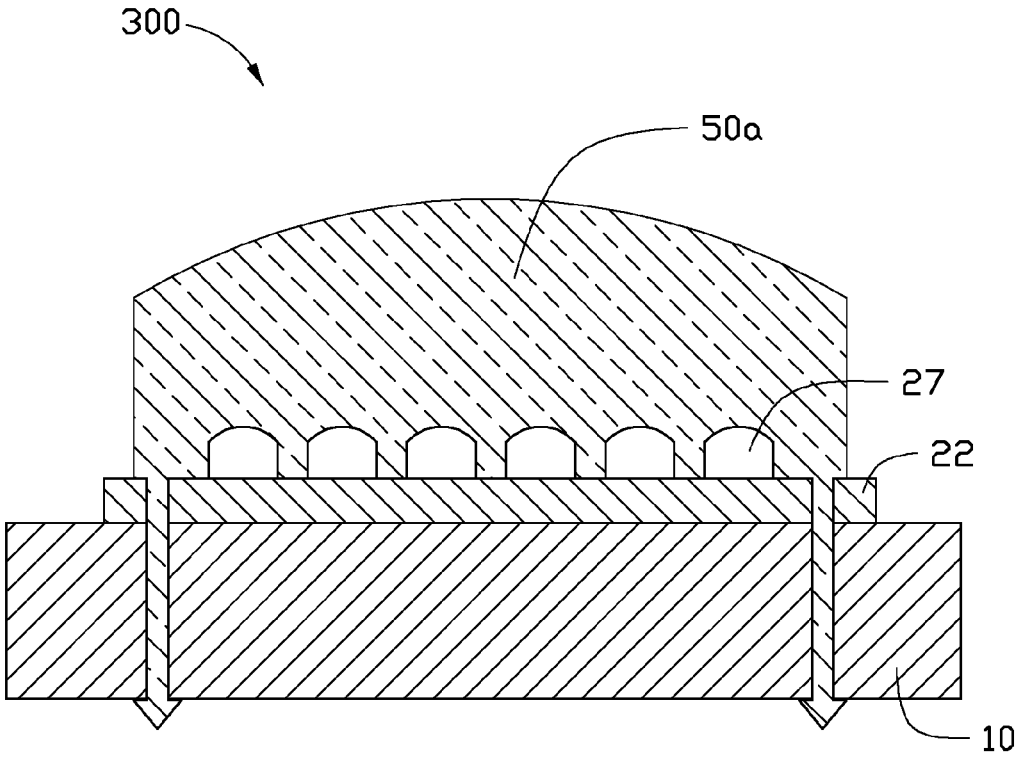
FIG. 6 is a schematic view of an LED light emitting device in accordance with a third embodiment of the disclosure.

Also referring to FIG. 6, an LED light emitting device 300 in accordance with a third embodiment is shown. The differences of the third embodiment relative to the first embodiment are that: the LED light emitting device 300 further includes a solid envelope 50*a* covering the LEDs 24 on the heat conductive plate 22, and an inner face of the envelope 50*a* contacts the heat conductive plate 22 and the encapsulants 27 of the LEDs 24.

Figure 7:
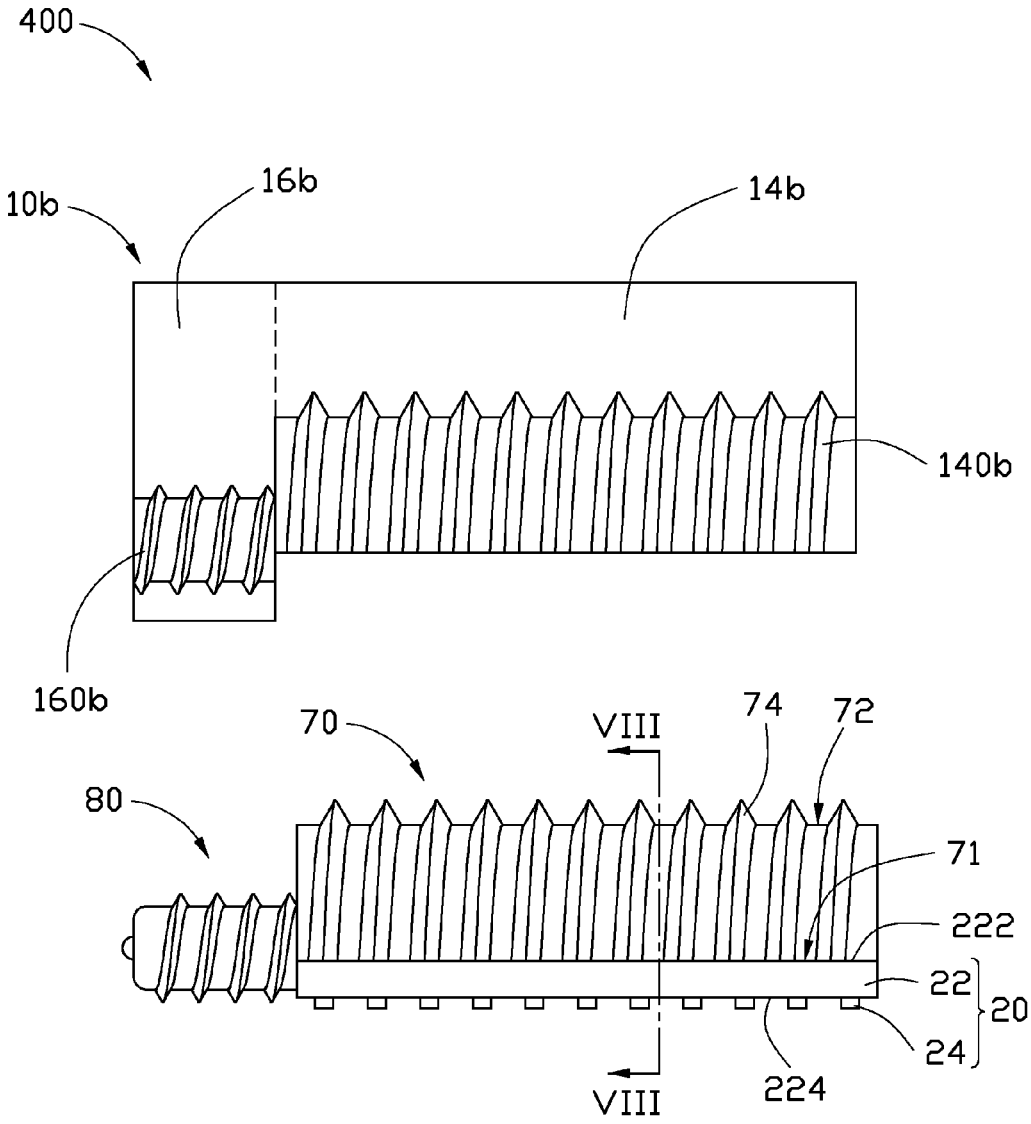
FIG. 7 is a schematic view of an LED light emitting device in accordance with a fourth embodiment of the disclosure.
Figure 8:
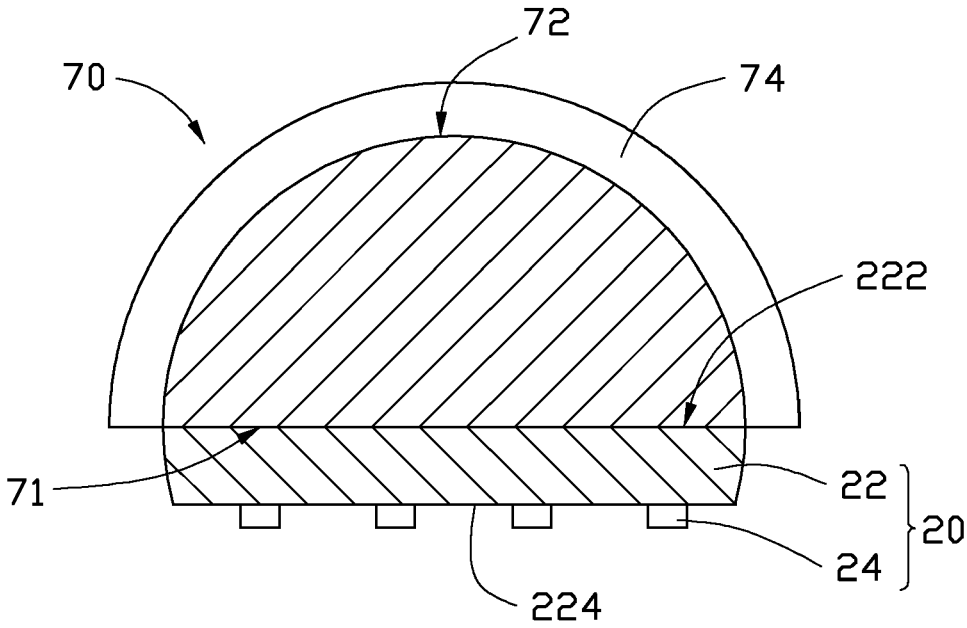
FIG. 8 is a cross-section view of the LED light emitting device of FIG. 7, taken along a line VIII-VIII thereof.

Referring to FIGS. 7 and 8, an LED light emitting device 400 in accordance with a fourth embodiment of the disclosure is illustrated. The differences of the fourth embodiment relative to the previous embodiments are that: the LED light emitting device 400 further comprises a heat sink 70 thermally connecting the LED light emitting component 20, and a connecting head 80 extending outwardly from an end the heat sink 70. The lamp housing 10*b* of the LED light emitting device 400 is also different from the lamp housings 10 of the previous embodiments in shape.

The heat sink 70 is integrally made of a metal with good heat conductivity such as aluminum, copper or an alloy thereof. The heat sink 70 comprises a base and a plurality of fins 74 formed on an outer surface of the base. The base has a semicircular cross section, and defines a planar face 71 and a curved face 72 at an outer circumference of the heat sink 70. The LED light emitting component 20 is thermally attached on the planar face 71 of the base. The fins 74 are arranged on the curved face 72 of the base and spaced from each other. The fins 74 extend spirally along an axis of the base, acting as threads around the base.

The heat conductive plate 22 is a flat plate and defines a planar first engaging face 222 and a planar second engaging face 224 opposite to the first engaging face 222. The first engaging face 222 is thermally attached to the planar face 71 of the heat sink 70. The LEDs 24 are evenly arranged on the second engaging face 224 of the heat conductive plate 22.

The connecting head 80 electrically connects each of the LEDs 24 of the LED light emitting component 20 with the power source driver 60. A plurality of threads (not labeled) are formed on an outer circumference of the connecting head 80. The connecting head 80 is screwedly engaged with the lamp housing 10*b*. The lamp housing 10*b* comprises a main body 14*b* and an engaging body 16*b* extending from an end of the main body 14*b*. The main body 14*b* has an arced configuration and defines a curved inner face (not labeled) recessed inwardly. A plurality of inner threads 140*b* are defined in the inner face of the main body 14*b* for engaging with the fins 74 of the heat sink 70. An engaging hole (not labeled) is defined in the engaging body 16*b* for receiving the connecting head 80. A plurality of engaging threads 160*b* are defined in an inner face of the engaging hole for engaging with the threads of the connecting head 80. In assembly, the connecting head 80 is threadedly inserted into the engaging hole of the engaging body 16*b*, and the fins 74 of the heat sink 70 are threadedly engaged with the inner threads 140*b* of the main body 14*b*. Thus, the engagement between the fins 74 of the heat sink 70 and the inner threads 140*b* of the lamp housing 10*b* is intimate enough to achieve a good heat conduction therebetween.

Figure 9:
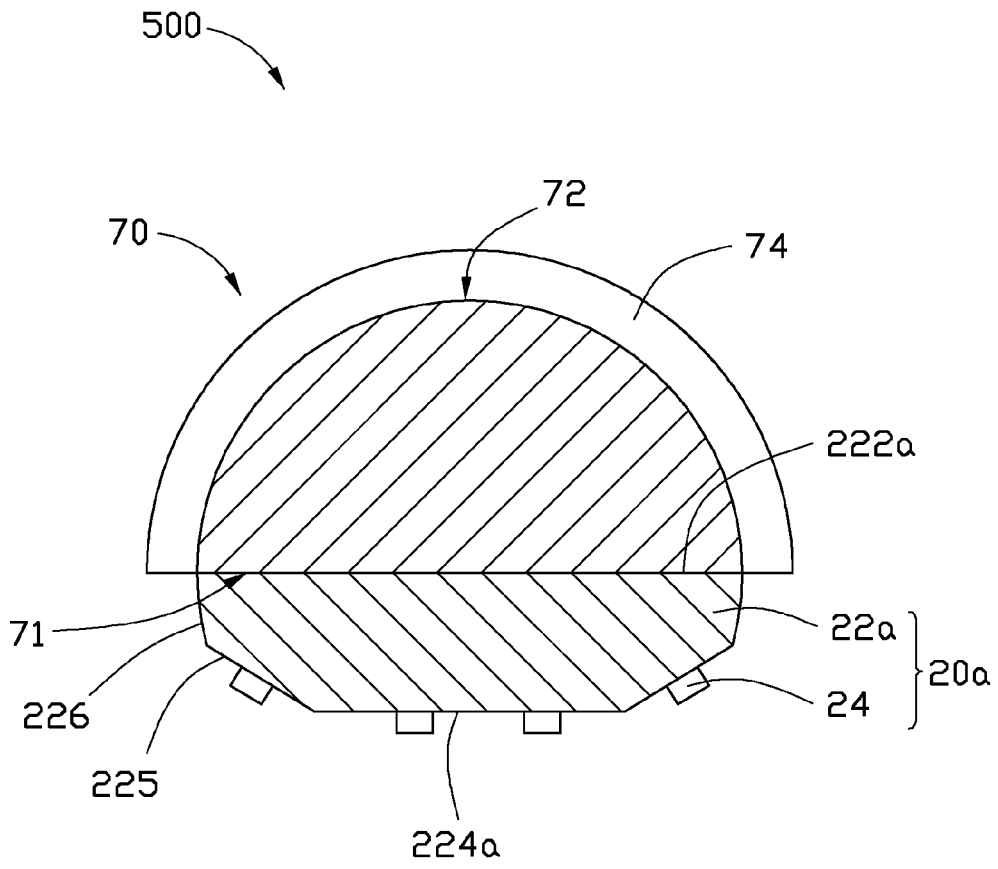
FIG. 9 is a view similar to FIG. 8 but showing an LED light emitting device in accordance with a fifth embodiment of the disclosure.

Referring to FIG. 9, an LED light emitting device 500 in accordance with a fifth embodiment of the disclosure is illustrated. The difference of the fifth embodiment relative to the fourth embodiment is in that the profiles of the heat conductive plates 22, 22*a*. In the fifth embodiment of this disclosure, the heat conductive plate 22*a* of the LED light emitting component 20*a* has a configuration like a pentagonal prism, and includes a planar first engaging face 222*a* thermally attached to the planar face 71 of the heat sink 70, a planar second engaging face 224*a* opposite to the first engaging face 222*a*, two slantwise faces 225 extending slantwise from two sides of the second engaging face 224*a* towards the first engaging face 222*a*, and two arced faces 226 respectively connecting the slantwise faces 225 and the first engaging face 222*a*. The LEDs 24 are respectively arranged on the second engaging face 224*a* and the slantwise faces 225 of the heat conductive plate 22*a*, whereby light emitted by the LEDs 24 can be oriented in different directions to produce a broadened illumination.

Figure 10:
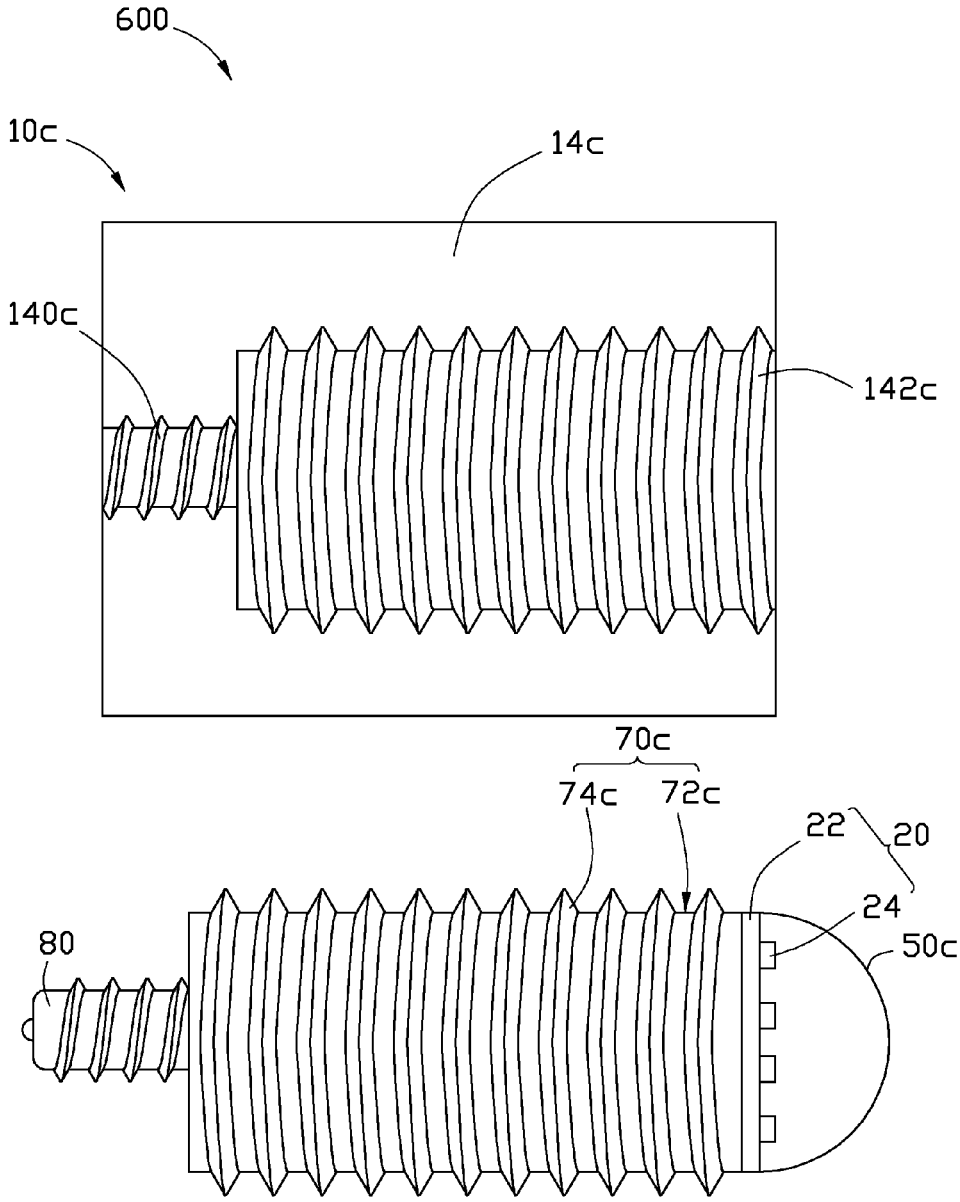
FIG. 10 is a schematic view of an LED light emitting device in accordance with a sixth embodiment of the disclosure.

Referring to FIG. 10, an LED light emitting device 600 in accordance with a sixth embodiment of the disclosure is illustrated. The differences of the sixth embodiment relative to the fourth embodiment are that: the base of the heat sink 70*c* is columnar, and defines a curved face 72*c* at an outer circumference of the heat sink 70*c*. The LED light emitting component 20 is thermally attached on one end of the base, and the connecting head 80 extends from another end of the base opposite to the LED light emitting component 20. The fins 74*c* are formed on the curved face 72*c* of the base and spaced from each other. The fins 74*c* extend spirally along an axis of the base, acting as threads around the base. An envelope 50*c* covers the LED light emitting component 20, for further isolating water vapor from the LEDs 24. The main body 14*c* of the lamp housing 10*c* is columnar and defines an engaging hole (not labeled) for receiving the connecting head 80 and the heat sink 70*c*. Inner threads 140*c*, 142*c* are formed on the inner face of the engaging hole for respectively engaging with the threads of the connecting head 80 and the fins 74*c* of the heat sink 70*c*. In assembly, the connecting head 80 and the heat sink 70*c* are threadedly inserted into the engaging hole of the lamp housing 10*c*.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED light emitting device, comprising:

a lamp housing;

an LED light emitting component thermally attached to the lamp housing, wherein the LED light emitting component comprises a heat conductive plate and a plurality of LEDs thermally attached to the heat conductive plate;

a power source driver for providing electric energy for the LED light emitting component;

a temperature sensor attached to the lamp housing for sensing a surface temperature of an outer surface of the lamp housing;

a heat sink thermally connecting the LED light emitting component and the lamp housing, the heat sink comprising a base and a plurality of fins extending outwardly from the base, the base having a semicircular cross section and comprising a planar face and a curved face at an outer circumference of the heat sink, the LED light emitting component being thermally attached on the planar face of the base, the fins being arranged on the curved face of the base and extending spirally along an axis of the base; and a connecting head extending from an end the heat sink, the connecting head electrically connecting each of the LEDs of the LED light emitting component with the power source driver, the lamp housing comprising a main body and an engaging body extending from an end of the main body, the main body having an arced configuration and comprising a curved inner face recessed inwardly, a plurality of inner threads being defined in the inner face of the main body, an engaging hole being defined in the engaging body, the connecting head being inserted into the engaging hole of the engaging body, the fins of the heat sink being threadedly engaged with the inner threads of the main body;

wherein when the value of the surface temperature is smaller than a predetermined temperature value, the temperature sensor outputs a control signal to the power source driver to control the power source driver to supply a larger electric current to the LED light emitting component, and the LED light emitting component generates more heat to the lamp housing to increase the surface temperature thereof.

2. The LED light emitting device of claim 1 further comprising an envelope covering the LEDs on the heat conductive plate.

3. The LED light emitting device of claim 1, wherein the heat conductive plate comprises a planar first engaging face thermally attached to the planar face of the heat sink, a planar second engaging face opposite to the first engaging face, and two slantwise faces extending slantwise from two sides of the second engaging face towards the first engaging face, the LEDs being respectively arranged on the second engaging face and the slantwise faces of the heat conductive plate.

4. The LED light emitting device of claim 1, wherein a plurality of threads are formed on an outer circumference of the connecting head, a plurality of engaging threads being defined in an inner face of the engaging hole of the engaging body, the engaging threads of the engaging body being threadedly engaged with the threads of the connecting head.

5. The LED light emitting device of claim 1, wherein the LED light emitting component further comprises an electrode circuit layer formed on the heat conductive plate, each LED comprising a substrate, an LED die disposed on the substrate, two electrodes formed on the LED die, and an encapsulant encapsulating the LED die, the electrodes electrically connecting with the electrode circuit layer.

6. The LED light emitting device of claim 5, wherein the heat conductive plate and the LEDs are joined together by eutectic bonding, whereby an eutectic layer is formed between the heat conductive plate and the LEDs, the electrode circuit layer being spaced from the eutectic layer.

7. The LED light emitting device of claim 5, wherein the heat conductive plate is made of electrically-insulating ceramic material selected from $Al_xO_y$, AlN or $ZrO_2$, and the electrode circuit layer is directly formed on the heat conductive plate.

8. An LED light emitting device, comprising:

a lamp housing;

an LED light emitting component thermally attached to the lamp housing, wherein the LED light emitting component comprises a heat conductive plate and a plurality of LEDs thermally attached to the heat conductive plate;

a power source driver for providing electric energy for the LED light emitting component;

a temperature sensor attached to the lamp housing for sensing a surface temperature of an outer surface of the lamp housing; and a heat sink and a connecting head connected with the heat sink, the heat sink comprising a base and a plurality of fins extending outwardly from the base, the base of the heat sink being columnar and having a curved face at an outer circumference of the heat sink, the LED light emitting component being thermally attached on one end of the base, and the connecting head extending from another end of the base opposite to the LED light emitting component, the fins being formed on the curved face of the base and extending spirally along an axis of the base, the lamp housing defining an engaging hole, a plurality of inner threads being formed on the inner face of the engaging hole, the connecting head and the heat sink being threadedly engaged with the inner threads of the lamp housing;

wherein when the value of the surface temperature is smaller than a predetermined temperature value, the temperature sensor outputs a control signal to the power source driver to control the power source driver to supply a larger electric current to the LED light emitting component, and the LED light emitting component generates more heat to the lamp housing to increase the surface temperature thereof.

* * * * *